US010292504B2

(12) United States Patent
Gordon

(10) Patent No.: US 10,292,504 B2
(45) Date of Patent: May 21, 2019

(54) FOOTREST AND METHOD OF MAKING SAME

(71) Applicant: Mary Gordon, Chicago, IL (US)

(72) Inventor: Mary Gordon, Chicago, IL (US)

(73) Assignee: Mary Gordon, Chicago, IL (US)

( * ) Notice: Subject to any disclaimer, the term of this patent is extended or adjusted under 35 U.S.C. 154(b) by 54 days.

(21) Appl. No.: 15/612,490

(22) Filed: Jun. 2, 2017

(65) Prior Publication Data

US 2017/0360205 A1 Dec. 21, 2017

Related U.S. Application Data

(60) Provisional application No. 62/352,743, filed on Jun. 21, 2016.

(51) Int. Cl.

| | |
|---|---|
| ***A47C 7/00*** | (2006.01) |
| ***A47C 16/02*** | (2006.01) |
| ***A45C 5/02*** | (2006.01) |
| ***A45C 9/00*** | (2006.01) |
| ***A45C 13/26*** | (2006.01) |
| ***A45C 13/00*** | (2006.01) |
| ***A47C 5/00*** | (2006.01) |

(52) U.S. Cl.

CPC ..... *A47C 16/025* (2013.01); *A45C 5/02* (2013.01); *A45C 9/00* (2013.01); *A45C 13/005* (2013.01); *A45C 13/26* (2013.01); *A47C 5/005* (2013.01)

(58) Field of Classification Search

CPC ..... A47C 5/005; A47C 16/02

See application file for complete search history.

(56) References Cited

U.S. PATENT DOCUMENTS

| | | | | | |
|---|---|---|---|---|---|
| 4,705,173 | A * | 11/1987 | Forbes, Jr. | B65D 71/72 | 206/563 |
| 4,757,937 | A * | 7/1988 | Maio | B65D 5/3635 | 206/562 |
| 4,832,257 | A * | 5/1989 | Wood | B65D 5/242 | 206/427 |
| 4,991,908 | A * | 2/1991 | Krechel | A47C 16/02 | 108/132 |
| 5,244,255 | A * | 9/1993 | Mill | A47C 16/02 | 248/222.52 |
| 5,484,078 | A * | 1/1996 | Bronovicki | B65D 25/04 | 220/528 |
| 5,829,729 | A * | 11/1998 | Welch | A47B 23/044 | 248/441.1 |
| 6,036,269 | A * | 3/2000 | Colton | A47C 5/005 | 297/423.41 |
| 6,170,908 | B1 * | 1/2001 | Jewell | A47C 13/00 | 297/118 |
| D558,991 | S * | 1/2008 | Vardy | D6/353 | |

(Continued)

*Primary Examiner* — Shin H Kim

(74) *Attorney, Agent, or Firm* — DLA Piper LLP (US)

(57) ABSTRACT

Systems of a footrest are described, along with a process for making the footrest. The footrest may include a base with at least four side walls connected by a bottom side. The base may be folded into a flat or box shape. The footrest may also include a container lid connected by a bottom lid and a top lid, and the base may be configured to join with the container lid. The base may also fit inside the container lid when folded, and the bottom lid of the container lid includes at least two semi-circular shaped depressions.

14 Claims, 9 Drawing Sheets

(56) References Cited

U.S. PATENT DOCUMENTS

| | | | | |
|---|---|---|---|---|
| 2003/0047979 | A1* | 3/2003 | Carom | A47C 16/02 297/423.45 |
| 2006/0103219 | A1* | 5/2006 | Sardana | A47C 16/02 297/423.41 |
| 2009/0145340 | A1* | 6/2009 | Parvizian | A47C 16/02 108/137 |
| 2015/0334982 | A1* | 11/2015 | Fogle | A01K 1/0114 119/166 |
| 2016/0031626 | A1* | 2/2016 | Chan | B31D 5/0004 206/592 |
| 2016/0286752 | A1* | 10/2016 | Fogle | A01K 1/0114 |
| 2016/0360937 | A1* | 12/2016 | Naik | G08C 17/02 |
| 2017/0360205 | A1* | 12/2017 | Gordon | A47C 16/025 |

* cited by examiner

FOOTREST AND METHOD OF MAKING SAME

CROSS REFERENCE

This application relates to and claims priority from U.S. Provisional application 62/352,743 filed on 21 Jun. 2016 the entirety of which is hereby incorporated by reference.

FIELD

This disclosure relates to the field of modular support structures.

BACKGROUND

The disclosure relates to a footrest, and a method of making a footrest.

There is interest in the manufacture of footrests that are operable, easy to assemble and lightweight. There is further interest in providing a footrest that does not require a large area of storage space.

In many embodiments, these footrests have a resting area where users can place their feet, and a support mechanism used to hold the resting area. However, these footrests may be burdensome to carry, difficult to assemble and take up a large area of space.

SUMMARY

These, as well as other aspects, advantages and alternatives, will become apparent to those of ordinary skill in the art by reading the following detailed description, with reference, where appropriate, to the accompanying drawings.

Systems and methods here include a footrest, and methods for making and using such a footrest including one with a base including at least four side walls connected by a bottom side, wherein the four side walls and bottom side may be folded into a flat shape and folded into a box shape, a container lid including at least four side walls connected by a bottom lid and a top lid, wherein the base is configured to join with the container lid when in the box shape, wherein the base is configured to fit inside the container lid when in the folded shape, and wherein the bottom lid of the container lid includes at least two semi-circular shaped depressions.

BRIEF DESCRIPTION OF THE DRAWINGS

The embodiments will be more readily understood in view of the following description when accompanied by the below figures, wherein like numerals reference and represent like elements, wherein.

DETAILED DESCRIPTION

Reference will now be made in detail to embodiments, examples of which are illustrated in the accompanying drawings. In the following detailed description, numerous specific details are set forth in order to provide a sufficient understanding of the subject matter presented herein. But it will be apparent to one of ordinary skill in the art that the subject matter may be practiced without these specific details. Moreover, the particular embodiments described herein are provided by way of example and should not be used to limit the scope of the invention to these particular embodiments. In other instances, well-known data structures, timing protocols, software operations, procedures, and components have not been described in detail so as not to unnecessarily obscure aspects of the embodiments of the invention.

Overview

A footrest with simple assembly and portability therefore provides a solution. The solution also provides a footrest that may be easily collapsed, and stored in both large and small spaces.

The disclosure here includes systems of a footrest and methods of making the same. In certain example embodiments, such a footrest may collapse into a flat or substantially flat shape. In certain example embodiments, alternatively or additionally, the footrest may fold into a portable briefcase shape. In certain embodiments, portions of the footrest may collapse and be stored in the top lid of the footrest, forming a briefcase shape.

More specifically, the solution provides a footrest, where the footrest may have generally two pieces, a base and a top foot rest container. The top container lid footrest may include an indented area for one or more heels of a user. Alternatively or additionally, the container lid footrest may include a forward rest portion. Further, the top side of the container lid of the footrest may be used to close the system, and form a container, as well as support the integrally joined base and container are also included in the footrest. Further, the solution provides a footrest, where a removable and storable height adjusting mechanism is provided.

The solution further discloses a method where the footrest or a portion is folded into a flat or generally flat piece or pieces. It may then be transported or stored. In operation, it may be assembled by first opening the top container lid using a plurality of grip edges, removing a folded up base portion and forming a base from the folded up base portion by arranging its four side walls and bottom side and configuring the base portion with the container lid footrest. A top side of the container lid footrest may then support the integrally joined container and base. Further, the removable and storable height adjusting mechanism may then be configured for accommodating different height demands by users.

Portable Two Piece Footrest Embodiments

Figure 1B:
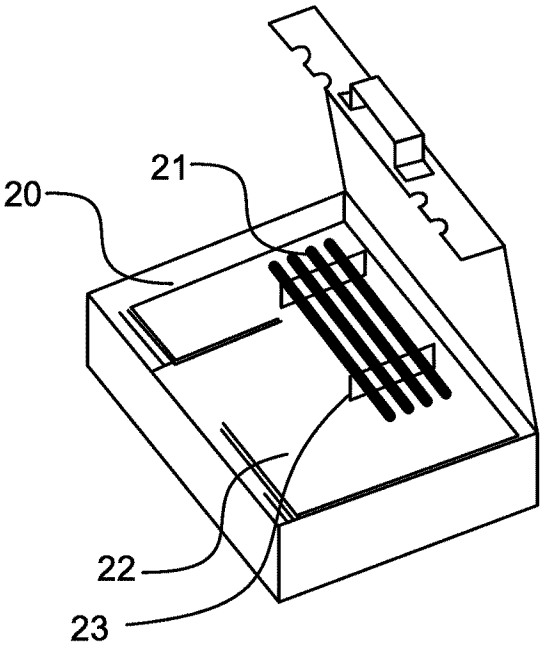
FIG. 1B is a view of the container lid after the container lid is opened, and the base with four side walls connected by the bottom side stored in the container lid, according to an example embodiment.
Figure 1A:
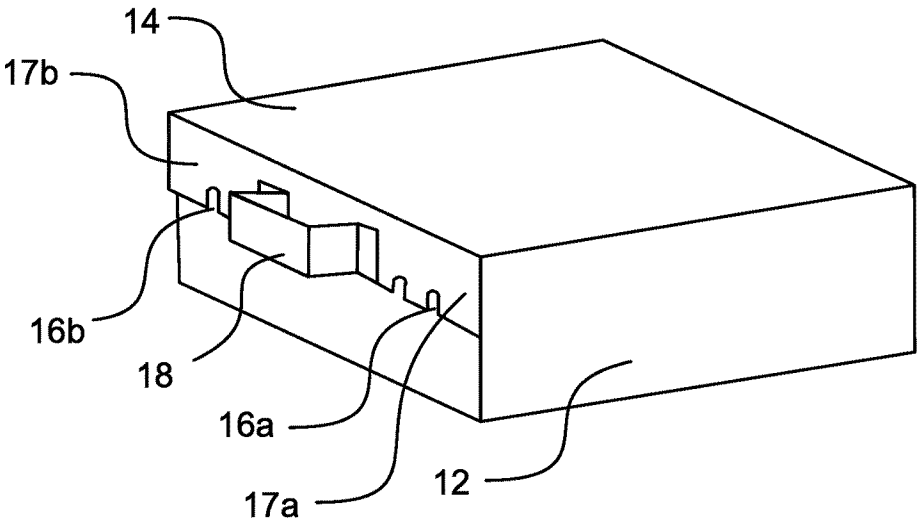
FIG. 1A is a view of the container lid before the container lid is opened, and the base with four side walls connected by the bottom side stored in the container lid, according to an example embodiment.

In an example embodiment, a representative footrest or footstool is shown in FIGS. 1A and 1B. The terms footstool, footrest, rest, or other terms may be used interchangeably in the disclosure. They are not intended to be limiting but merely helpful to explain the ideas and the invention presented.

Referring to FIG. 1A, an example container lid footrest 12, is shown in a closed and portable configuration. As shown, the component parts of the footrest may thus form into a lightweight and portable device. The container lid footrest portion 12 may be configured to allow for storage of the base components of the footrest in a compact space. Any component of the embodiments may be made of any kind of material, including but not limited to plastic, wood, cardboard fiberglass, carbon fiber, ceramics, paper, or any other lightweight and sturdy material. The container lid footrest 12 may include a top lid 14, which may be arranged to house the container lid footrest 12 when in a portable configuration. This top lid 14 may also be used to support the footrest, when assembled as described below.

In some embodiments, the top lid 14 of the container lid footrest 12 may include a plurality of grip edges 16*a* and 16*b* on a right side 17*a* and left side 17*b* on the top lid 14 of the container lid footrest 12, that may be used to open the container lid footrest 12. In such embodiments, the plurality of grip edges 16*a* on the right side 17*a* and 16*b* on the left side 17*b* of the top lid 14 on the container lid footrest 12 may be grasped and lifted to open the container lid footrest 12 by a user. The plurality of grip edges 16*a* and 16*b* on the right side 17*a* and left side 17*b* of the top lid 14 on the container lid footrest 12 may also be curved. In some embodiments, these grip edges may not be present. In some embodiments, the grip edges are made of different material than the lid itself, such as rubber or tacky plastic. In some embodiments, there may be four grip edges in the plurality of grip edges 16*a* and 16*b*, with two grip edges 16*a* on the right side 17*a* on the top lid 14 of the container lid footrest 12, and two grip edges 16*b* on the left side 17*b* on the top face 14 of the container lid footrest 12. In some embodiments, the container lid footrest 12 may include a handle 18, used to move and carry the footrest when in the portable position. Any number of handles may be configured, including a small handle for a single grip, a double sized grip, a shoulder strap, a shoulder loop, or any combination of the above. The handle could be made of any kind of material, including, but not limited to, the same materials or different materials as the two portions of the footrest itself.

FIG. 1B shows the footrest with a top lid 14 opened to reveal another component inside, the folded up base portion 22. An interior side 20 of the container lid footrest 12, when in the portable configuration, may hold the base portion when folded up. The base portion 22, when assembled, may have five sides in a box shape, including a front wall, back wall, two side walls and a floor, and can be made of any material, including, but not limited to, plastic, wood, cardboard, ceramics, porcelain, carbon fiber, fiberglass, paper or any other lightweight and sturdy material. The four side walls with the bottom side 22 may be used to form a base 22, and configure the container lid footrest 12 when fully assembled. Further, the removable and storable height adjusting mechanism 21, detachably fixed by the holder 23, may be stored in the container lid footrest 12 for adjusting height of the footrest when assembled for use.

Figure 2:
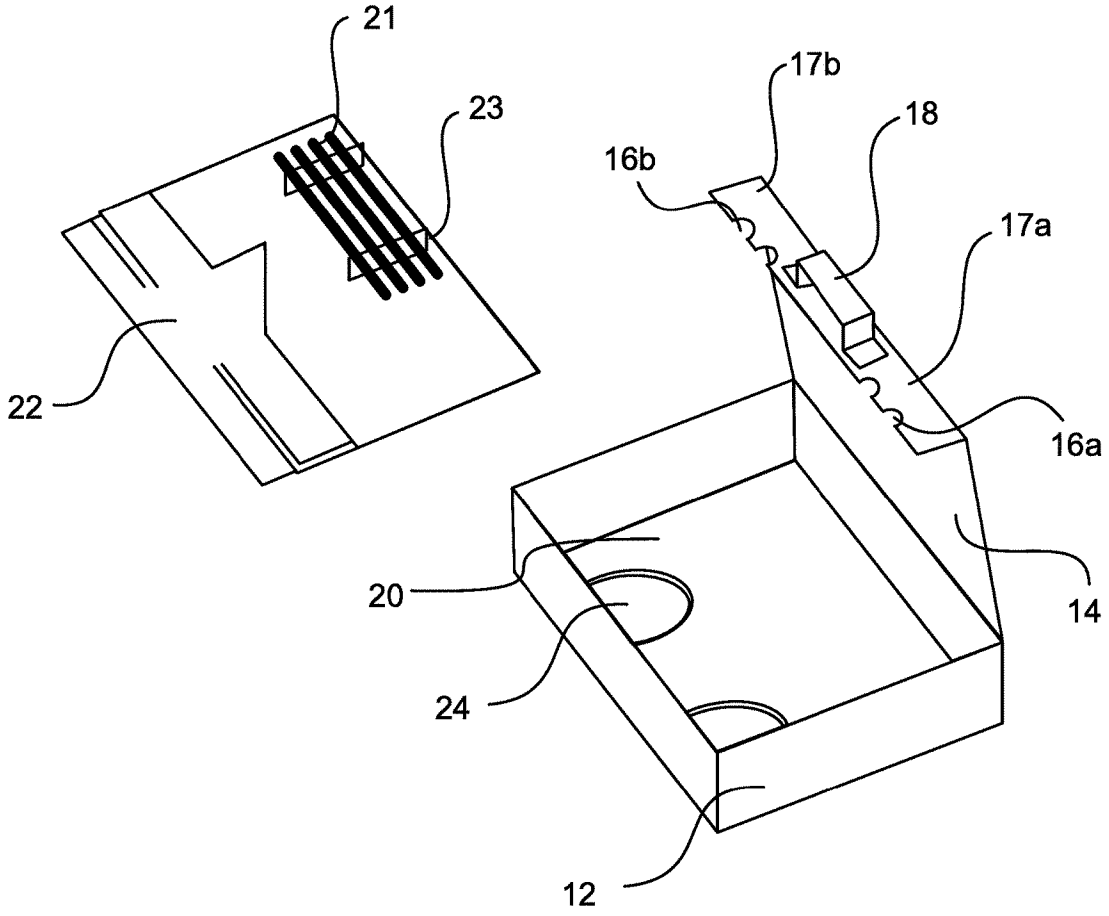
FIG. 2 is a view of the base with four side walls connected by the bottom side removed from the container lid, according to an example embodiment.

Referring now to FIG. 2, a view of the opened container lid footrest 12, and the base portion 22 in a folded up configuration, is shown in an example embodiment. In the view of this example embodiment, the plurality of grip edges 16*a* on the right side 17*a* of the top lid 14 of the container lid footrest 12 and the left side 17*b* on the left side 17*b* of the top lid 14 of the container lid footrest 12 may be used to open the container lid footrest 12. The handle 18 may also be used to open the container lid footrest 12, and expose an interior side 20 of the container lid footrest 12, once the base four side walls with the bottom side 22 are removed. In some embodiments, the interior side 20 of the container lid footrest 12 may include two depressions 24, used to store flaps (not shown).

As can be seen in the example embodiment shown in FIG. 2, the top lid footrest container portion includes two cut out portions that may be used by a user to place his or her heels in operation as discussed below. It should be understood that the removable and storable height adjusting mechanism 21 and the holder 23 may be liberally determined to be located liberally.

Example Assembly of the Two Piece Footrest

Figure 3:
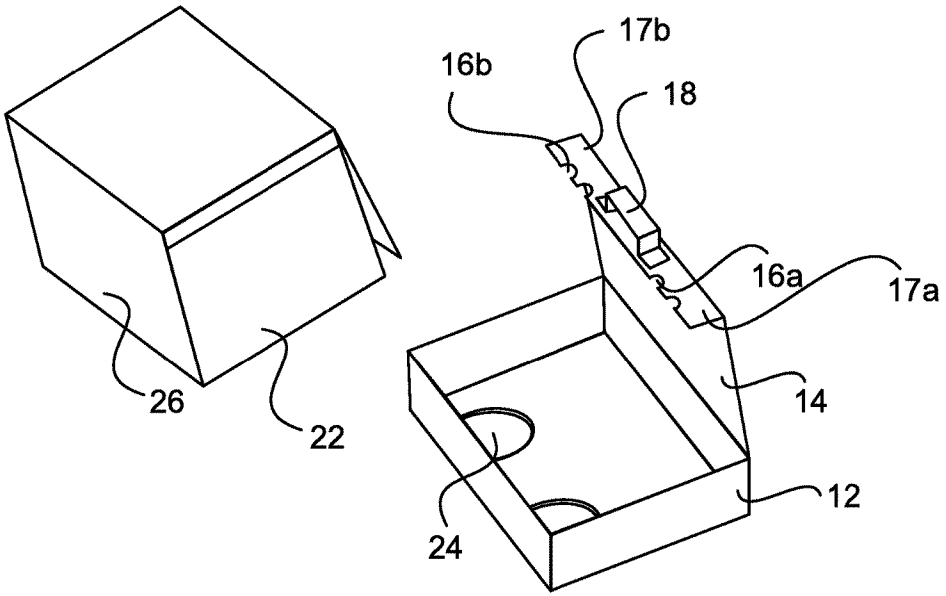
FIG. 3 is a view of the base after folding the four side walls and the bottom side, and the open container lid, according to an example embodiment.

Referring now to FIG. 3, the base portion 22 is shown being assembled into a box shape with the four side walls with the bottom side 26 in an example embodiment. After removing the folded up base portion 22 from the container lid footrest 12 when in the portable configuration, the four side walls with the bottom side 26 of the base portion can be unfolded, and manipulated to form a box shape. In certain embodiments, the base 22, when assembled, may not have a top lid portion, and will instead have a floor, two side walls and a front and back wall. In such examples, the place where the lid would go may be open. The walls of the base 22 may be assembled into a box shape by any of various ways including but not limited to magnets, hook and loop attachments, adhesive, tab and slots, or other ways. The folded base 22 may be unfolded and arranged into a box shape as shown to form a rigid base section for the assembled footrest, as described below. The sides of the base or other portions that hinge, could be made in any of various ways. In some embodiments, the hinges may be living hinges, formed out of the same material as the sides of the lid 12 and base 22. In some embodiments, the hinges may be knuckle and bolt mechanical hinges, magnetic hinges, spiral bound wire hinges, tabbed hinges, or any other kind of hinge that allows the walls to bend relative to one another but remained connected to form a sturdy base when assembled. The hinges could be made of metal, plastic, cardboard, fiberglass, composite, or any other kind of material, either the same as the sides of the footrest, or different, and attached to them.

Figure 4:
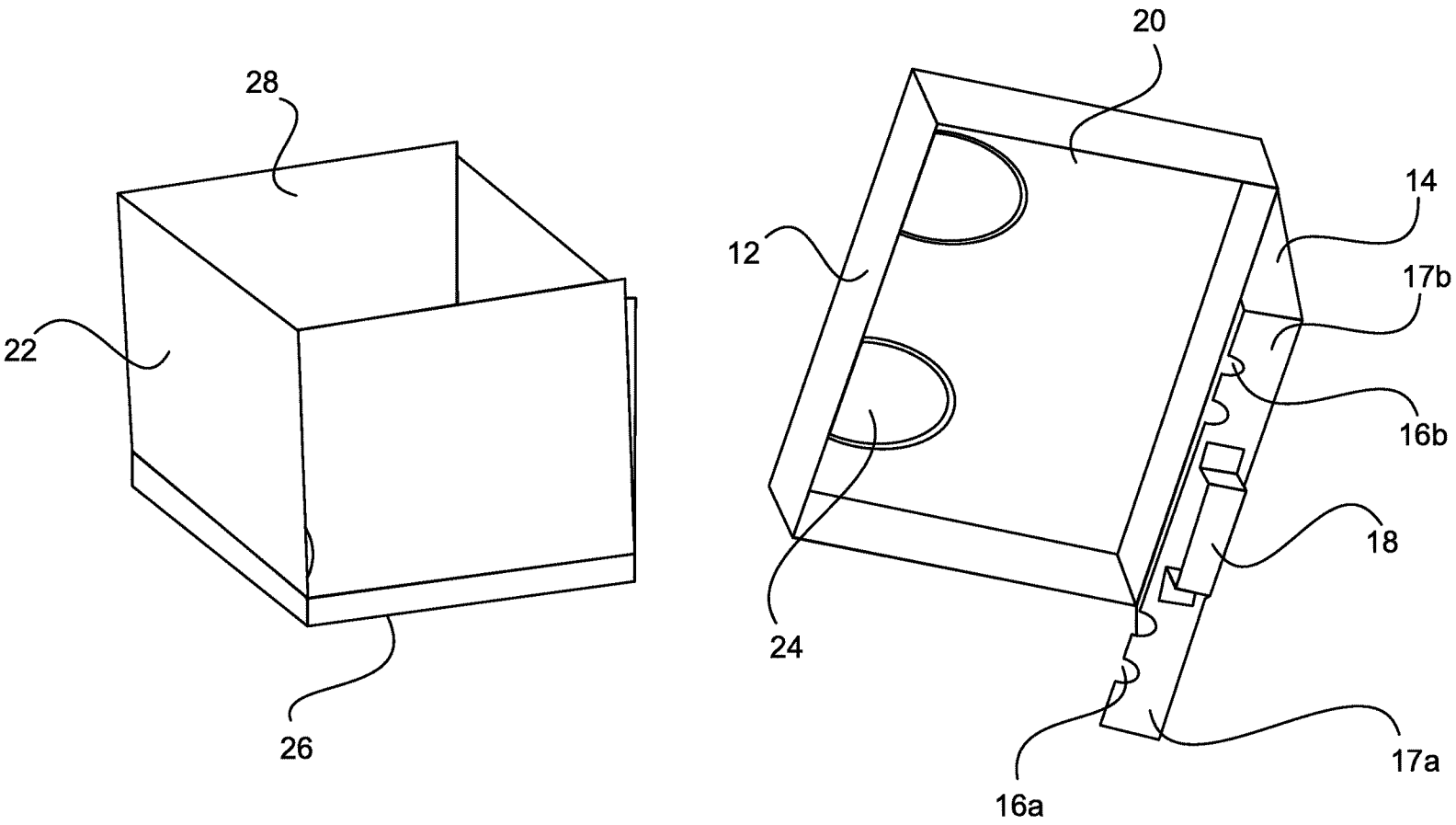
FIG. 4 is a close-up view of the base, and a side view of the bottom lid of the container lid, the depressions and the container lid, according to an example embodiment.

Referring now to FIG. 4, another view of the base 22 and the opening 28 of the base 22, along with a side view of the opened container lid footrest 12 in an example embodiment is shown. The container lid footrest 12 can be turned, in order for the interior side 20 of the container lid footrest 12, and the depressions 24 matingly engaging flaps, on a bottom lid of the container lid footrest 12, to integrally join the base 22 as assembled into a box shape. The plurality of grip edges 16*a* and 16*b* of the right side 17*a* and left side 17*b* on the top lid 14 of the container lid footrest 12 and the handle 18 can be used to move the container lid footrest 12 to the base 22, with the opening 28 defining the base 22.

Figure 5:
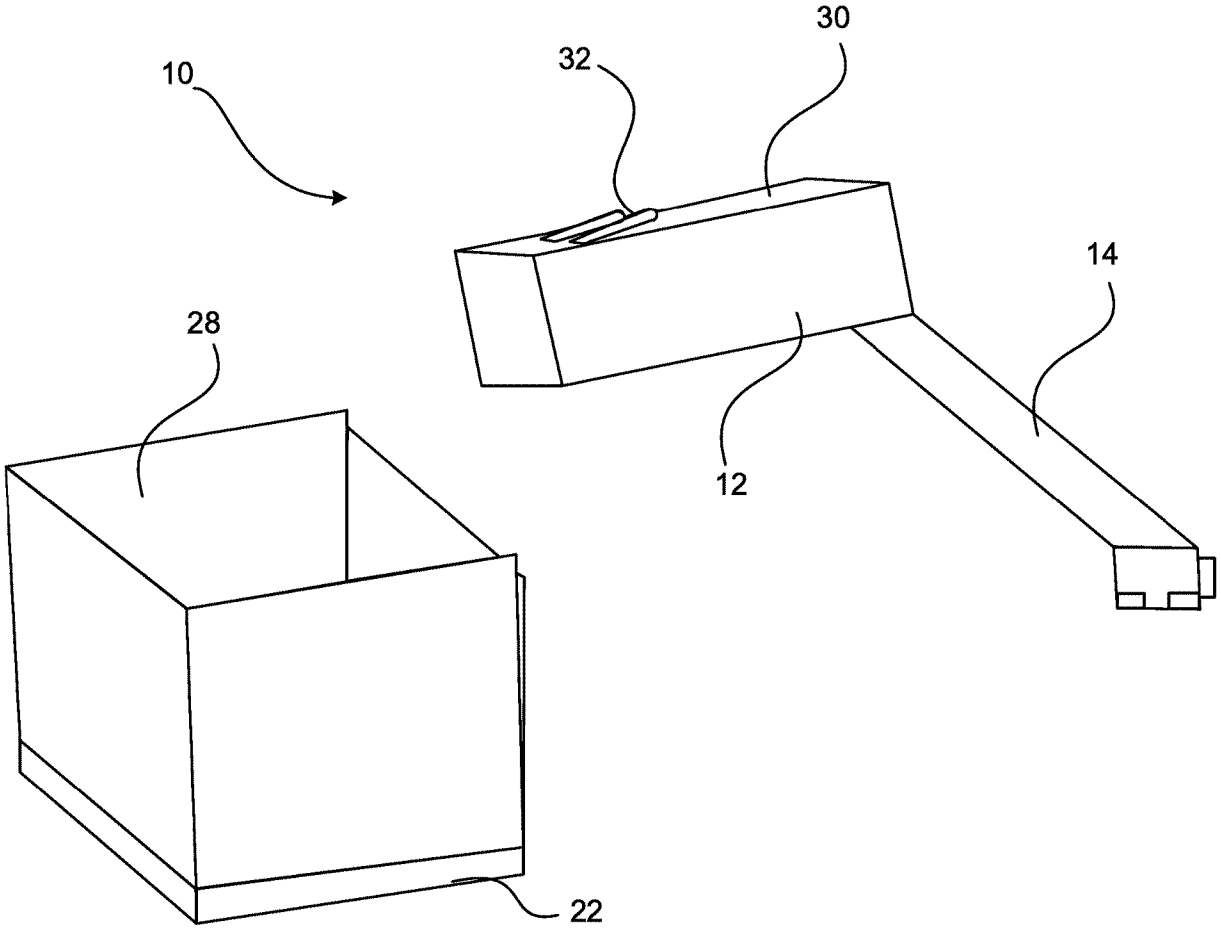
FIG. 5 is a view of the base and the container lid before configuring, and a view of the flaps on the bottom lid of the container lid, according to an example embodiment.

Referring now to FIG. 5, a view of the container lid footrest 12 and the base 22 before integrally joining is shown in an example embodiment. The container lid footrest 12 may integrally join to the base 22 by placing the interior side 20 not shown, of the lid footrest container lid footrest 12 on the opening 28 of the base 22. As a result, a bottom lid 30 of the container lid footrest 12 may be visible on the footrest when assembled. In certain embodiments, the bottom lid 30 of the container lid footrest 12 may have flaps 32, in which a user of the footrest will be able to rest the heels of their feet. When a user rests their feet on the flaps 32, the flaps 32 will matingly engage the depressions, not shown, through an opening, not shown. The top lid 14 of the container lid footrest 12 may be placed at an angle, in order to support the assembled footrest 10, when the container lid footrest 12 and the base 22 integrally join. The bottom lid 30 may support a user's feet, as well as the depressions 24 as well as the top lid 14.

Figure 6:
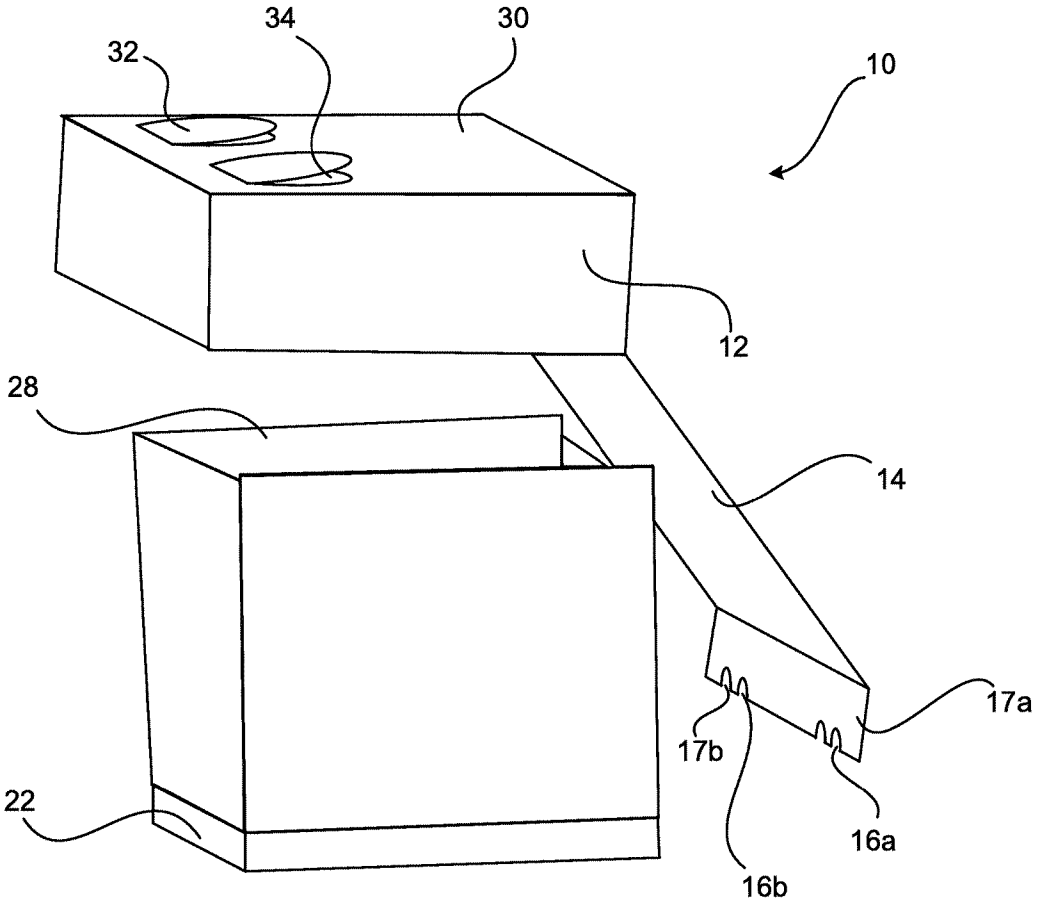
FIG. 6 is a close-up view of the base and the container lid before configuring, and a close-up view of the flaps on the bottom lid of the container lid, according to an example embodiment.

Referring now to FIG. 6, another view of the container lid footrest 12 and the base 22 before integrally joining, in an example embodiment is shown. The interior side 20, not shown, of the container lid footrest 12 may be placed directly above the opening 28 of the base 22. By doing so, the top lid 14 of the container lid footrest 12 may be in contact with the base 22 when the container lid footrest 12 and the base 22 integrally join, and support a weight when the flaps 32 on the bottom lid 30 of the container lid footrest 12 are pressed into the opening 34 of the bottom lid 30 of the container, and matingly engage the depressions 24, not shown. In some embodiments, the plurality of grip edges 16*a* of the right side 17*a* on the top lid 14 of the container lid footrest 12 and the plurality of grip edges 16*b* of the left side 17*b* on the top lid 14 of the container lid footrest 12 is used to anchor the top lid 14 of the container lid footrest 12, and prevent movement of the assembled footrest 10, when a user's weight is placed on the footrest.

It should be noted that in certain example embodiments, the base portion 22 has three side walls of the same size, and one which is shorter. In such embodiments, this may allow for the lid of the container lid footrest 14 to hang over one side and bend at any angle, depending on the user's preference. The top of the lid with the left 17*b* and right 17*a* sides may fold back flat with the ground or surface the footrest is sitting on. This lid may support a foot in an alternate way as well as the top of the container lid footrest in its assembled configuration.

Assembled Footrest Examples

Figure 7:
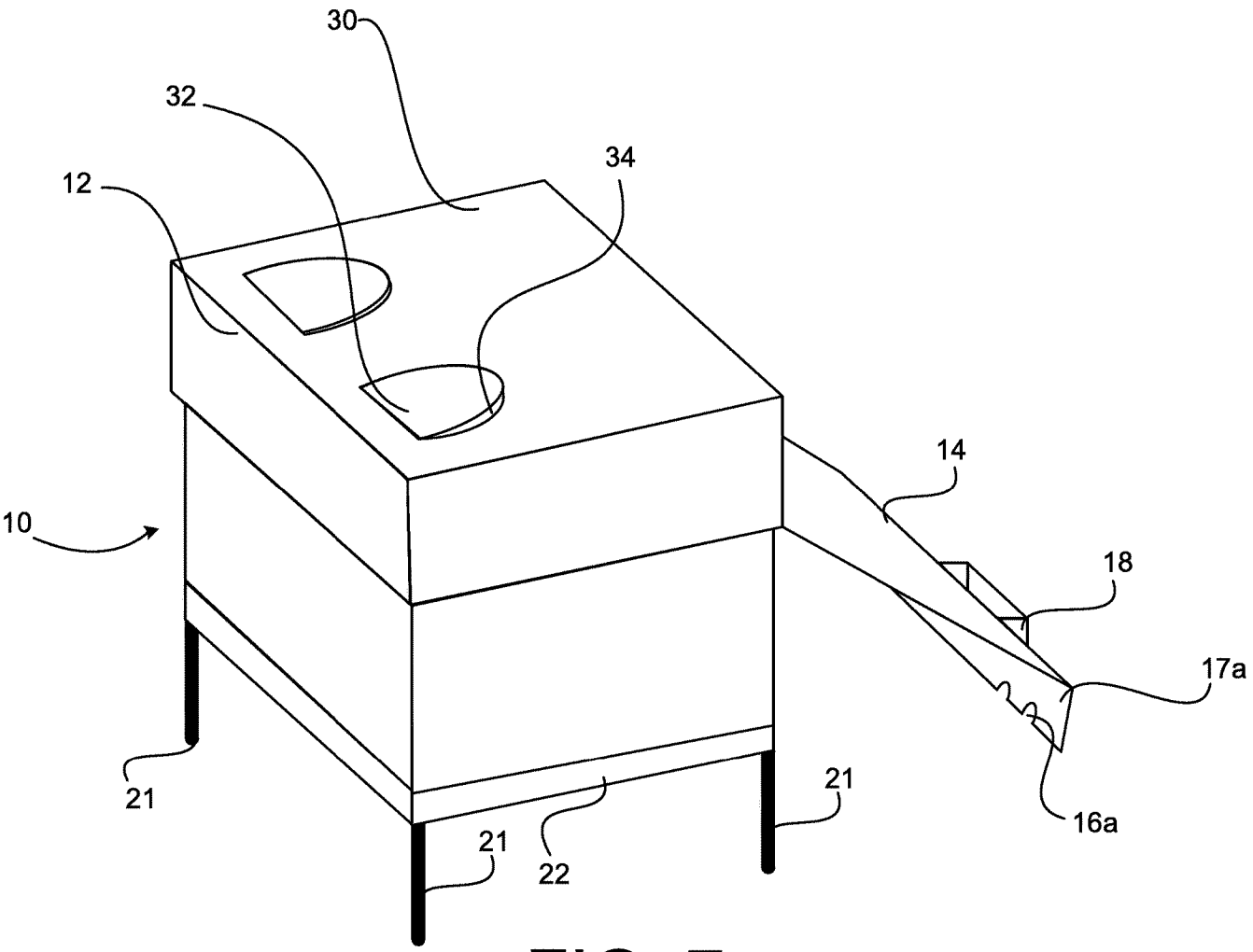
FIG. 7 is a close-up view of the configured base and container lid, according to an example embodiment.

Referring now to FIG. 7, a view of the assembled footrest 10, after integrally joining the container lid footrest 12 and the base 22, is shown in an example embodiment. The base 22 is used to support a user's weight, not shown, when pressing down on the flaps 32 of the bottom lid 30 of the container lid footrest 12. After pressing down on the flaps 32 of the bottom lid 30 of the container lid footrest 12, the flaps 32 will enter the openings 34 of the bottom lid 30 of the container lid footrest 12, allowing for the flaps 32 to matingly engage the depressions, not shown. After integrally joining the containing lid footrest 12 and the base 22, a user may have an option to attach the removable and storable height adjusting mechanism 21 at each corner of the base 22 for a desired height.

The top lid 14 of the container lid footrest 12 can be placed at an angle, in order to support the container lid footrest 12 and the base 22. By being placed at the angle, the top lid 14 of the container lid footrest 12 may redistribute the weight placed on the assembled footrest 10, and prevent the assembled footrest 10 from collapsing. The handle 18 can be used to assist in moving the top lid 14 of the container lid footrest 12 to a desired angle, while the plurality of grip edges 17*a* of the right side 16*a* on the top lid 14 of the container lid footrest 12 are used to anchor the top lid 14 of the container lid footrest 12 into a surface not shown, and prevent movement of the footrest 10.

Figure 8:
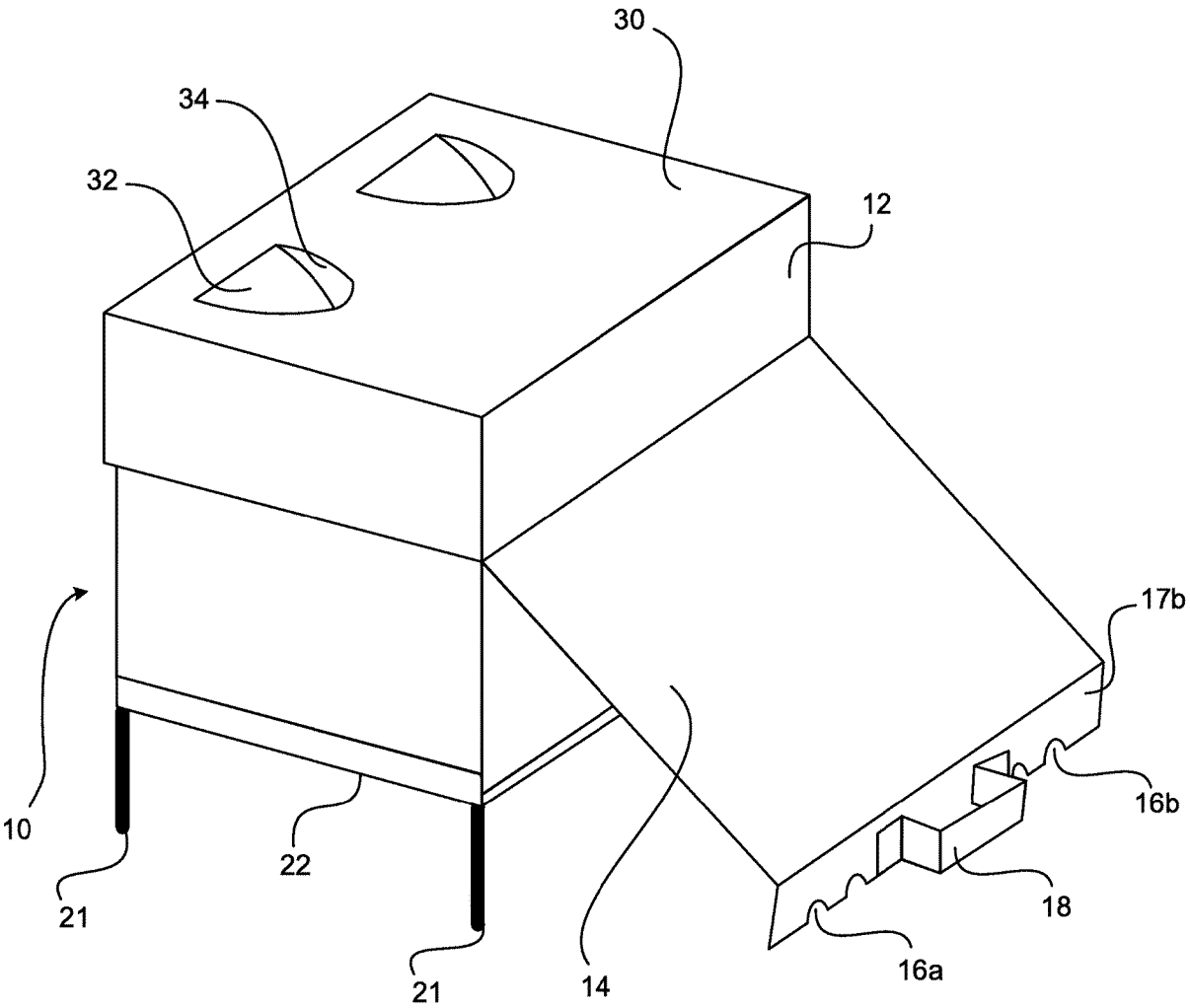
FIG. 8 is another close-up view of the configured base and container lid, and a close-up view of the flaps, according to an example embodiment.

Referring now to FIG. 8, another view of the footrest 10, after integrally joining the container lid footrest 12 and the base 22, in an example embodiment is shown. After integrally joining the base 22 with the interior side 20 of the container lid footrest 12, not shown, the flaps 32 may be pressed by a user's feet. When this occurs, the flaps 32 may enter the openings 34 on the bottom lid 30 of the container lid footrest 12, and matingly engage the depressions 24, not shown. The handle 18 can be used to assist in moving the top lid 14 of the container lid footrest 12 to a desired angle, while the plurality of grip edges 17*a* of the right side 16*a* on the top lid 14 of the container lid footrest 12 and the plurality of grip edges 16*b* on the left side 16*b* on the top lid 14 of the container lid footrest 12 are used to anchor the top lid 14 of the container lid footrest 12 into a surface not shown, and prevent movement of the assembled footrest 10. After integrally joining the containing lid footrest 12 and the base 22, a user may have an option to attach the removable and storable height adjusting mechanisms 21 at each corner of the base 22 for a desired height.

Regarding the optional height adjusting mechanisms 21, they are shown in FIG. 8 as rods, or cylindrically shaped supports. It should be noted that any kind of shape could be used as height adjusting mechanisms 21 including but not limited to cylinders, prism including a rectangular prism, triangular prism, or other kind of shape. Additionally, such height adjusting mechanisms 21 may be made of any kind of material including but not limited to plastic, metal, wood, cardboard, or other stiff material. In some examples, the height adjusting mechanism is screwed into the base 22 using a male and female threaded screw arrangement. In some examples, the height adjusting mechanisms 21 are attached using magnets of opposite poles in the base 22. In some examples, height adjusting mechanisms 21 may snap into recesses in the base 22 with a plastic malleable lip and snap fit. In some examples, the height adjusting mechanisms 21 slide into a recess in the base 22 with a lip or tongue and groove arrangement.

In some examples, the height adjusting mechanisms 21 are able to adjust height as well as attach to the base 22. In such examples, a telescoping screw mechanism may be used to lengthen and shorten the height adjusting mechanisms 21 before or after attaching them to the base 22.

Figure 9:
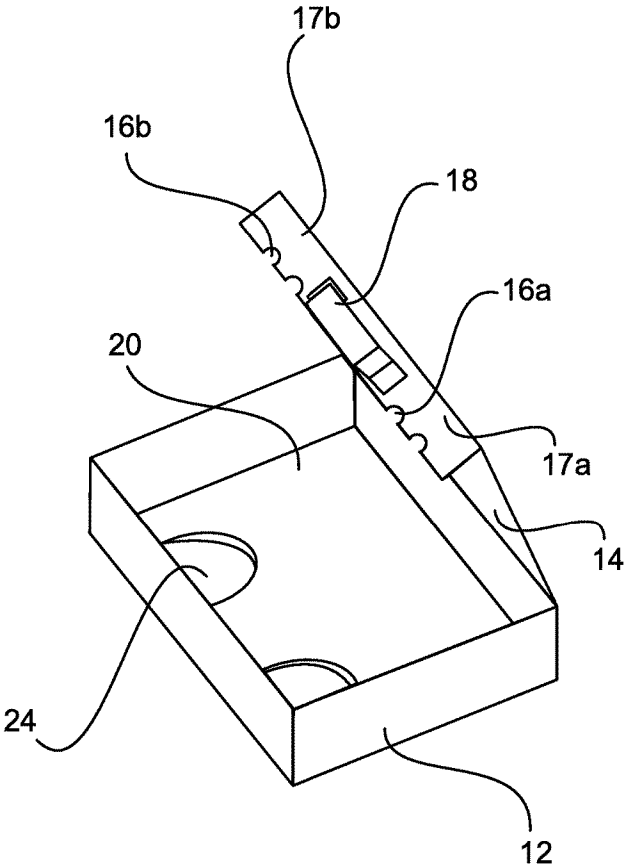
FIG. 9 is a view of the four side walls with the bottom side and the container lid, bottom lid of the container lid and depressions after opening the top lid of the container, according to an example embodiment.
Figure 9:
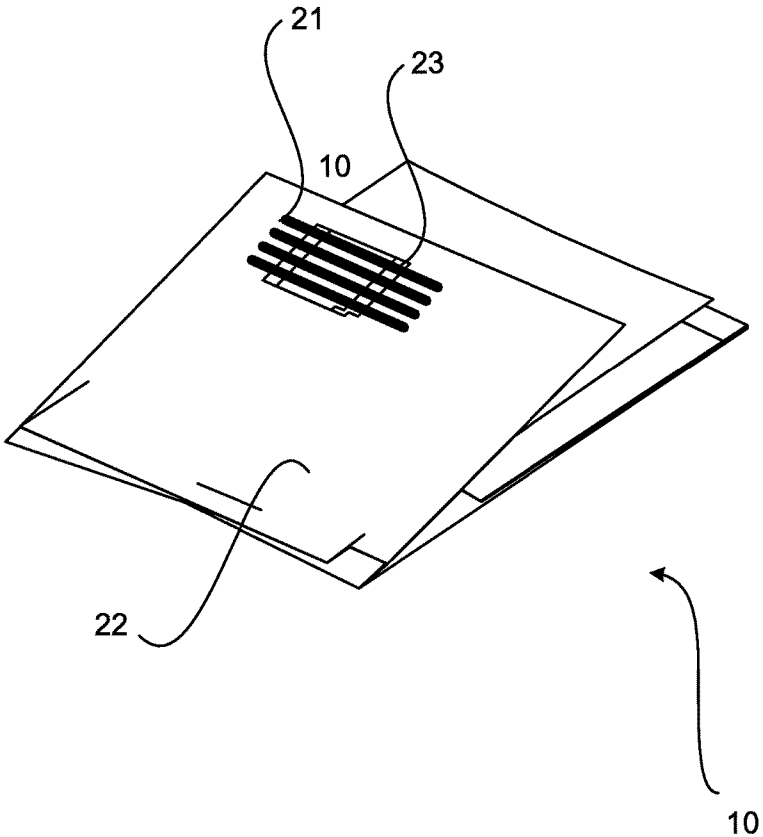

Referring now to FIG. 9, a view of the four side walls of the base portion 22 folded up, and the container lid footrest 12, after deconstructing the assembled footrest 10 in an example embodiment is shown. The footrest 10 may be deconstructed by first lifting the top lid 14 of the container lid footrest 12, the plurality of grip edges 16*a* on the right side 17*a* of the top lid 14 on the container lid footrest 12, the plurality of grip edges 16*b* on the left side 17*b* of the top lid 14 on the container lid footrest 12, and the handle 18.

The interior face 20 of the container lid footrest 12 may then be removed from the base 22, and cause the container lid footrest 12 and the base 22 to no longer be integrally joined. As a result, the user will no longer be able to press the flaps 32, not shown, of the bottom lid 30, not shown, of the container lid footrest 12. The depressions 24 will then become visible in the interior lid 20 of the container lid footrest 12. Finally, the base 22 may be collapsed into the four side walls with the bottom side, which can then be placed into the interior lid 20 of the container lid footrest 12. Once this is accomplished, moving the handle 18 or the top lid 14 of the container lid footrest 12 in a downward direction closes the container lid footrest 12.

It should be noted that a plastic cover could be used to encase the footrest system for portability and protection against dirt, water and the elements.

CONCLUSION

The foregoing description, for purpose of explanation, has been described with reference to specific embodiments. However, the illustrative discussions above are not intended to be exhaustive or to limit the embodiments to the precise forms disclosed. Many modifications and variations are possible in view of the above teachings. The embodiments were chosen and described in order to best explain the principles of the embodiments and its practical applications, to thereby enable others skilled in the art to best utilize the various embodiments with various modifications as are suited to the particular use contemplated.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although certain presently preferred implementations of the embodiments have been specifically described herein, it will be apparent to those skilled in the art to which the embodiments pertains that variations and modifications of the various implementations shown and described herein may be made without departing from the spirit and scope of the embodiments. Accordingly, it is intended that the embodiments be limited only to the extent required by the applicable rules of law.

What is claimed is:

1. A footrest, comprising:

a base including at least four side walls connected by a bottom, wherein the at least four side walls and bottom are configured to be folded into both a flat shape and folded into a box shape; and a container lid including at least four side walls connected by a bottom, wherein one of the container lid side walls is connected to a top, wherein the base is configured to join with the container lid when the base is in the box shape;

wherein the base is configured to fit inside the container lid when the base is in the folded shape; and wherein the bottom of the container lid includes at least two semi-circular shaped depressions.

2. The footrest of claim 1, wherein the base is comprised of plastic, wood, or cardboard.

3. The footrest of claim 2, wherein the lid of the container lid includes a handle.

4. The footrest of claim 1, wherein the container lid is comprised of plastic, wood, or cardboard.

5. The footrest of claim 1, wherein the at least two depressions are flaps.

6. The footrest of claim 3, wherein the handle is curved.

7. The footrest of claim 1, wherein the top side of the container lid includes a plurality of grip edges allowing the container to be opened.

8. The footrest of claim 7, wherein the plurality of grip edges are curved.

9. The footrest of claim 8, wherein the plurality of grip edges consists of four grip edges.

10. The footrest of claim 1, wherein the plurality of height adjusting mechanism is attached to the base.

11. A footrest, comprising:

a base including at least four side walls connected to a bottom side, wherein the at least four side walls are connected to the bottom side by living hinges that allow the four side walls to be folded into a flat shape and folded into a box shape; and a container lid including at least four side walls connected by a bottom and a top lid, wherein the base is configured to join with the container lid when the base is in the box shape;

wherein the base is configured to fit inside the container lid when the base is in the folded shape; and wherein the bottom of the container lid includes at least two semi-circular shaped depressions.

12. The footrest of claim 11, wherein the base is comprised of plastic.

13. The footrest of claim 12, wherein the lid of the container lid includes a handle.

14. The footrest of claim 11, wherein the container lid is comprised of plastic, wood, or cardboard.

* * * * *